United States Patent [19]

Nakano et al.

[11] Patent Number: 4,628,878

[45] Date of Patent: Dec. 16, 1986

[54] SPLASH LUBRICATING SYSTEM FOR AN ENGINE

[75] Inventors: Keiichi Nakano; Yoshio Tani; Tatsutoshi Umeda, all of Sakaishi, Japan

[73] Assignee: Kubota Ltd., Osaka, Japan

[21] Appl. No.: 781,462

[22] Filed: Sep. 30, 1985

[30] Foreign Application Priority Data

Oct. 5, 1984 [JP] Japan ..... 59-151592[U]

[51] Int. Cl.[4] ..... F01M 1/00

[52] U.S. Cl. ..... 123/196 R; 123/198 E; 123/195 C; 184/11.1; 184/13.1

[58] Field of Search ..... 123/198 E, 196 R, 195 C; 184/13.1, 11.1

[56] References Cited

U.S. PATENT DOCUMENTS

| | | | |
|---|---|---|---|
| 1,423,677 | 7/1922 | Nicholls | 184/13.1 |
| 1,494,647 | 5/1924 | Thomas | 184/13.1 |
| 1,506,553 | 8/1924 | Baldwin | 184/13.1 |
| 1,517,227 | 11/1924 | Brockway | 184/13.1 |
| 1,558,885 | 10/1925 | Hunt | 184/13.1 |
| 1,583,099 | 5/1926 | Rayfield | 184/13.1 |
| 1,789,384 | 1/1931 | Groehn | 184/13.1 |
| 1,892,849 | 1/1933 | Rayfield | 184/13.1 |
| 1,936,101 | 11/1933 | Baits et al. | 184/13.1 |
| 2,449,227 | 9/1949 | Hobart | 184/13.1 |
| 2,498,019 | 2/1950 | Thompson | 184/13.1 |
| 2,693,791 | 11/1954 | Lechtenberg | 184/13.1 |
| 4,404,936 | 9/1983 | Tatebe et al. | 123/196 R |
| 4,524,735 | 6/1985 | Bauder | 184/13.1 |

FOREIGN PATENT DOCUMENTS

| | | |
|---|---|---|
| 3119802 | 12/1945 | Japan . |
| 298814 | 7/1951 | Japan . |

*Primary Examiner*—E. Rollins Cross

*Attorney, Agent, or Firm*—Schwartz, Jeffery, Schwaab, Mack, Blumenthal & Evans

[57] ABSTRACT

A splash lubricating system for an engine having a crank case, a crank room formed in said crank case, an oil reserving room formed in lower part of said crank case for lubricating oil, and an oil splasher extending from a big end of the connecting rod downward so as to splash about lubricating oil from said reserving room to said crank room on its way from the front side to the back side along the lower part of its orbit, wherein the improvement involves a transverse partition covering over all of said oil reserving room, disposed in the upper space thereof, having an opening which allows said oil splasher to move therein, and three buffer plates covering front, right and left sides of said opening respectively for controlling oil level under them.

8 Claims, 4 Drawing Figures

SPLASH LUBRICATING SYSTEM FOR AN ENGINE

BACKGROUND OF THE INVENTION

1. Field of the Invention

The present invention relates to a splash lubricating system for an engine having a crank case, a crank room formed in said crank case, an oil reserving room formed in lower part of said crank case for lubricating oil, and an oil splasher extruding from a big end of the connecting rod downward so as to splash about oil from said oil reserving room to said crank room on its way from the front side to the back side along the lower part of its orbit, designed especially, for a system which functions powerfully and stably even when the oil level is moved in the oil reserving room in case that the engine mounted on an agricultural machine, for example, is inclined, and, of course, when the engine is run under the normal conditions.

2. Related Art

Many proposals related to the splash lubricating system, which has a fundamental structure premised and described above, have been made hitherto. For example, such a system having an oil receptacle or box fixed within an oil reserving room, and one or more passages penetrating the wall of said oil receptacle or box, so as to feed lubricating oil thereinto for splashing it by an oil splasher, are disclosed in Japanese Utility Model Publications No. 29-8814 and No. 31-19802. Lubricating oil is viscous and said passages are made so narrow, in these foregoing arts, that it takes a certain period of time for draining lubricating oil from said oil receptacle or box. Therefore, imperfect in lublication for short period is unavoidable in these foregoing arts.

However, it is observed at the normal running of an engine that the oil level is rises at both the lateral side of the oil splasher's orbital plane and descends down at the orbital plane, to be outstandingly transformed in a V-shape as designated by an imaginary line C in FIG. 3, and the volume of splashed lubricating oil is decreased by such transformation of oil level in said oil reserving room.

Each of these foregoing arts involve in their oil reserving room a small oil receptacle or box the width of which in the direction of the orbital plane of the oil splasher is made short. Therefore, lubricating oil brings out higher resistance against the splashing function of the oil splasher, and the volume of splashed lubricating oil becomes insufficient to match with the engine speed, although these foregoing arts are aimed to resolve imperfectness in lubricating function. Moreover, if the engine is inclined to the front side of the oil splasher, the oil level is inclined to descend toward the back side relatively, and the volume of splashed lubricating oil becomes insufficient. Thus, the systems according to these foregoing arts are difficult to keep powerful and stable lubrication.

SUMMARY OF THE INVENTION

Therefore, the present invention is aimed to propose a novel splash lubricating system for an engine, adopted to control the transformation of oil level adequately for keeping powerful and stable lubrication even when the engine is inclined, and of course when the engine is run in normal condition, without any special oil receptacle or box.

To this end, a splash lubricating system for an engine, according to the present invention, involves, in addition to the premised and abovementioned construction, a transverse partition covering said oil reserving room at the upper space thereof, having an opening which allows said oil splasher to move therein and three buffer plates covering front, right and left sides of said opening respectively for controlling oil level under them.

The two buffer plates, disposed at right and left sides of orbital plane of the oil splasher, stop the rise of oil level at these sides during normal running of the engine, so as to minimize V-shape transformation of oil level in the normal running of the engine, and to prevent descent of volume of splashed oil.

On the other hand, the buffer plate covering the front side of the opening, and front parts of the right and left buffer plates **12*a*** control oil level in the oil reserving room so as to stop the rise of oil level at the front side in the oil reserving room, and to prevent descent of volume of splashed oil, when the engine is inclined in the fore direction.

Thus, thanks to the transverse partition, the oil level along the orbit of the oil splasher is kept sufficiently high, and lubrication of the engine is always powerful and stable.

The present invention is adaptable in horizontal or inclined engines where the cylinder is extruded from the front side of the crank case horizontally or slantways, or in vertical engines.

In the case of inclined engines, the volume of splashed lubricating oil is smaller than in a horizontal engine, because the longer axis of oval orbit of oil splasher is laid more horizontally. But the decrease of the volume of splashed lubricating oil in comparison with the case of a horizontal engine is compensated by the function of the transverse partition raising the oil level higher at the orbital plane thereof. Moreover, the obstructive function of the transverse partition against the flow of lubricating oil toward the cylinder and against the penetration of lubrication oil into the combustion chamber is observed more outstandingly when the present invention is adapted in an inclined engine.

The transverse partition is preferably cast in a body with the lower peripheral wall of crank case, and the lower wall of oil reserving room, namely, an oil pan is fixed to the bottom surface of the crank case. In this way, the crank case is reinforced to increase rigidity at the gear case side where it is opened and therefore tends to have less rigidity. Moreover, the labor and time for assembling the partition transversely to the crank case are saved to decrease production cost. Furthermore, the crank case cast with a transverse partition in a body is able to be used as a common part with a vertical engine, if the opening through the transverse partition is closed. Therefore, massproduction effect is improved.

The front end of transverse partition is preferably located low toward the front with respect to the lower periphery of the bottom end of the cylinder, so as to break oil flow toward the cylinder by the lower periphery of the bottom end of the cylinder, and on the other hand, a drain hole is preferably formed through the buffer plate covering the front side of the opening, so as to drain off lubricating oil staying on the buffer plate to the oil reserving room therethrough. Thus, oil-up to the combustion chamber is avoided.

BRIEF DESCRIPTION OF THE DRAWINGS

The present invention will be understood more clearly and precisely upon reading the following detailed description of the preferred embodiment, which refers to the attached drawings, wherein.

DETAILED DESCRIPTION OF THE PREFERRED EMBODIMENT

Figure 1:
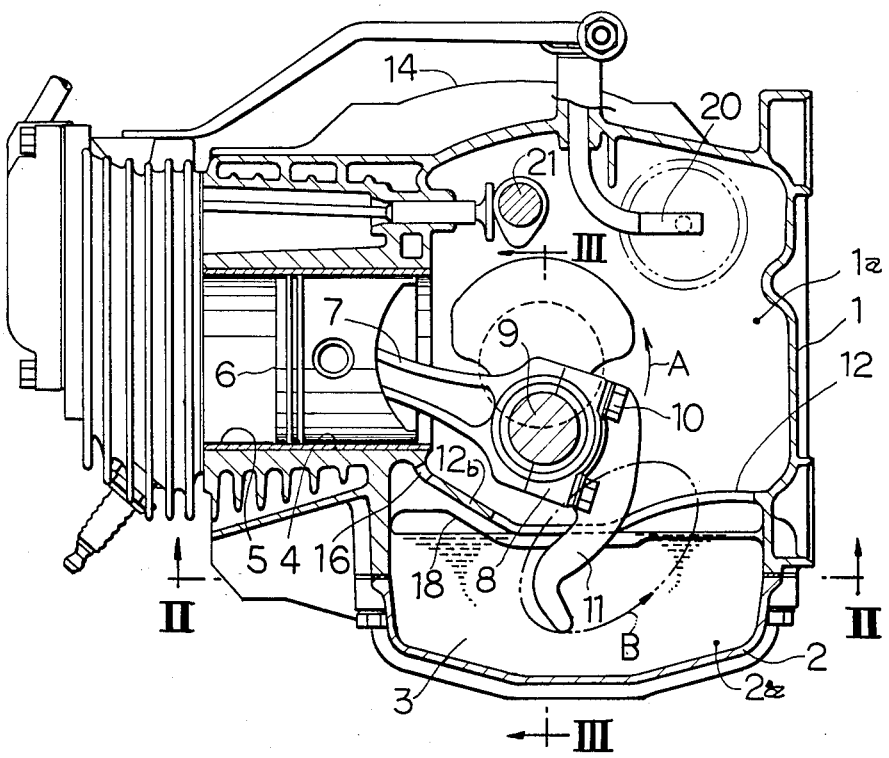
FIG. 1 is a partially sectioned side elevation of a horizontal engine according to the present invention.
Figure 2:
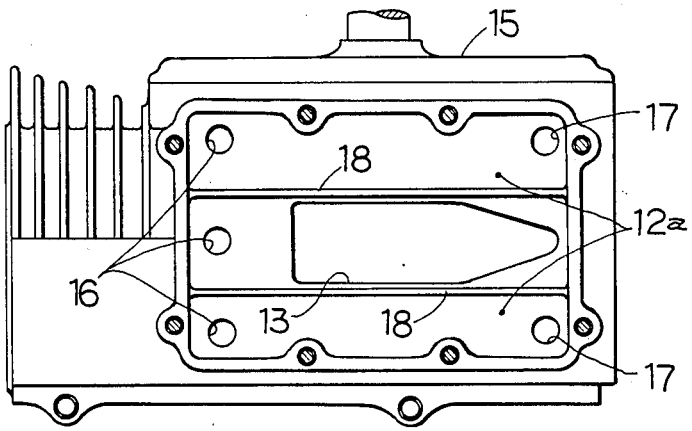
FIG. 2 is a bottom view of the crank case in the direction of arrows II—II.

Now, referring to the FIGS. 1 to 4, which designate a preferred embodiment of the present invention, the engine is provided with a crank case 1, an oil pan 2 and a cylinder 4. In the crank case 1, a crank room 1*a* is formed, and an oil reserving room 2*a* in the oil pan 2. Lubricating oil 3 is reserved in the oil reserving room 2*a*. A cylinder liner 5 is slidably fitted in the cylinder, and a piston 6 is inserted in the cylinder liner 5. The piston 6 is connected to the crank shaft 9 by a connecting rod 7 having a big end 8. An oil splasher 11 is fixed to the big end 8 by a pair of bolts 10. A governer lever 20 is rotatably fitted through the upper wall of the crank case 1. A cam shaft 21 is housed in the crank case 1. A cooling fan case 14 is disposed at the right side of the crank case 1, and a gear case 15 is disposed at the left side of the crank case 1.

A transverse partition 12 is disposed in the upper space of the oil reserving room 2*a* so as to cover all over the oil reserving room 2*a*. In the embodiment shown in FIGS. 1 to 4, the transverse partition 12 is cast in one body with the lower part of the peripheral wall of the crank case 1. And an oil pan 2 is fixed under the bottom surface of the crank case 1 below the transverse partition 12.

The transverse partition 12 has an opening 13 at the middle part along the orbital plane of the oil splasher 11, elonged in the direction of front and back (right and left in FIG. 1), allowing the oil splasher 11 to move back and forth therein.

Figure 4:
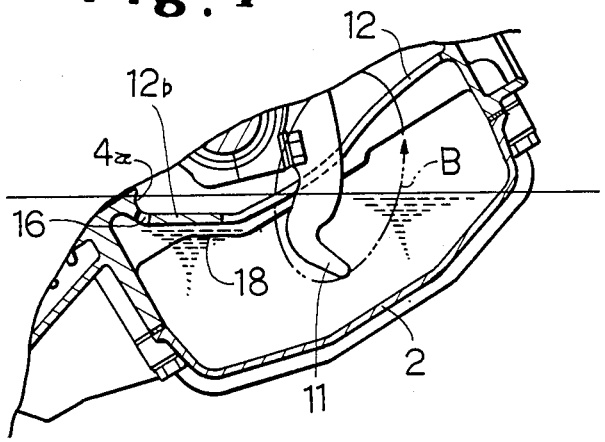
FIG. 4 is a sectioned side elevation of the oil reserving room according to the invention at the inclined state.

The free end of the oil splasher 11 travels along an oval orbit designated by an imaginary line in the direction designated by an arrow B in FIGS. 1 and 4, following the cranking motion (designated by an arrow A in the FIG. 1) of the big end 8 of the connecting rod 7, and splashes up lubricating oil from the oil reserving room 2*a* to the crank room 1*a*.

The transverse partition 12 also has two buffer plates 12*a* at the right and left sides, and another buffer plate 12*b* at the front side of its openning 13.

Drain holes 16, and 17 are formed through the transverse partition 12 at front and back ends thereof.

The transverse partition 12 is reinforced by a pair of ribs 18 extruded thereunder, backing up the reinforcing function of the transverse partition 12 for increasing the rigidity of the crank case 1.

Figure 3:
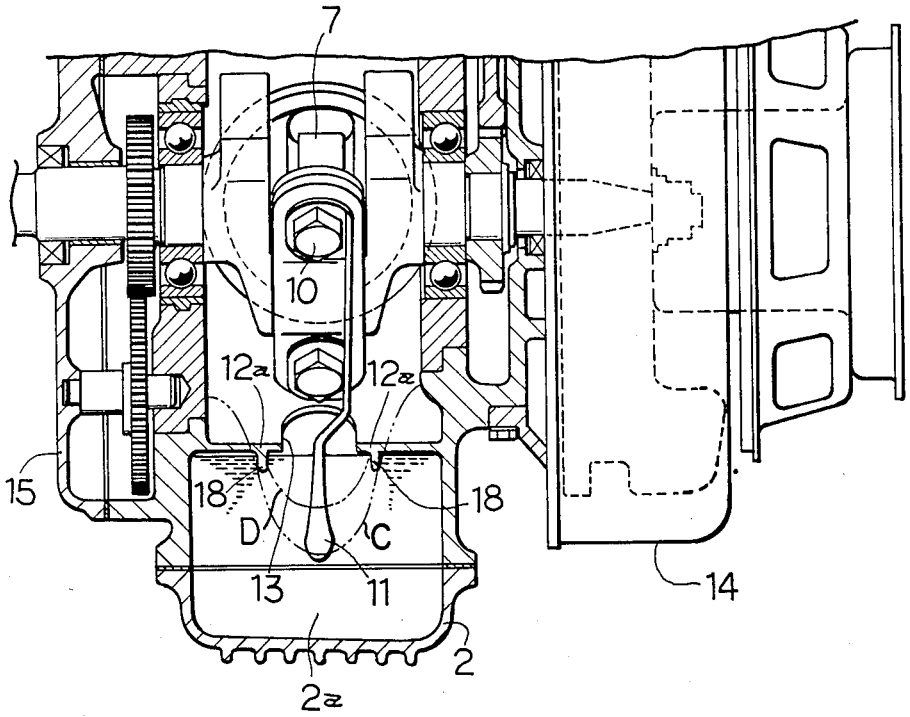
FIG. 3 is a vertical section along a line III—III in the FIG. 1.

During the normal running of the engine, lubricating oil 3 tends to rise up at the both right and left side of the orbital plane of oil splasher 11, and to transform the oil level in V-shape as designated by an imaginary line C in FIG. 3, corresponding to the dipping up of lubricating oil 3 at the orbital plane by the oil splasher 11. The rise of lubricating oil at the right and left side is stopped by the buffer plates 12*a*, and decreased transformation of the oil level as smaller as that designated by an imaginary line D in FIG. 3, to ensure sufficient volume of splashed lubricating oil.

Moreover, when the engine is inclined toward the front side as seen in FIG. 4, the oil level rises at the front side and descends at back side. The rise of oil level at the front side is controlled by the buffer plate 12*b* and the front parts of the buffer plates 12*a*, and the descent of the oil level is decreased to ensure sufficient volume of splashed lubricating oil. In case of horizontal engine, the buffer plates 12*a*, and 12*b* also serves as obstacles which arrest the flow of lubrication oil toward the interior of the cylinder 4 and the penetration of lubrication oil from the crank room 1*a* into the combustion chamber of the engine.

Furthermore, as the front end of the transverse partition 12 is located lower and toward the front with respect to the lower periphery 4*a* of the bottom end of the cyllinder, the flow of lubricating oil toward the cylinder is better arrested by the lower periphery of the bottom end of the cylinder 4. And on the other hand, drain holes 16 pass lubricating oil staying on the transverse partition 12 therethrough, so as to quickly return lubricating oil into the oil reserving room 2*a*. Thus, oil-up to the combustion chamber is avoided more certainly.

The drain holes 16 located at the front end of the transverse partition 12 may act to relieve air from the oil reserving room 2*a* to the crank room 1*a*, so as to prevent abnormal rise of oil level at the back side in the oil reserving room, when the engine is inclined to front side.

It is obvious that the present invention is not limited within the preferred embodiment described above, but include all the modifications within the scope and spirit of the invention implied in the following claims.

We claim:

1. A splash lubrication system for an engine comprising a crank case, a crank room formed in said crank case, an oil reserving room formed in a lower part of said crank case for lubricating oil, and an oil splasher extending from a big end of a connecting rod downward so as to splash oil from said oil reserving room to said crank room on its way from a front side to a back side along the lower part of its orbit, wherein improvement comprises:

a transverse partition substantially covering said oil reserving room, disposed at an upper space thereof, having an opening which allows said oil splasher to move therein, and three buffer plates covering front, right and left sides of said opening respectively for controlling oil level thereunder.

2. A splash lubricating system recited in claim 1, wherein:

said engine includes a cylinder extruded from the front side of the crank case.

3. A splash lubricating system recited in claim 1, wherein:

said engine is a horizontal engine and a cylinder is extruded from the front side of the crank case horizontally, said transverse partition is cast with the lower peripheral wall of said crank case, said oil reserving room is disposed under the bottom surface of said crank case below said transverse partition.

4. A splash lubricating system recited in claim 1, wherein:

the front end of said transverse partition is located lower and toward the front with respect to the lower periphery of the bottom end of the cylinder, and said transverse partition is provided with a drain hole formed through the buffer plate covering the front side of said opening at the front end of said buffer plate.

5. A splash lubricating system recited in claim 1 wherein said engine is a horizontal engine.

6. A splash lubricating system recited in claim 1 wherein said engine is an inclined engine.

7. A splash lubricating system recited in claim 2 wherein said cylinder is extruded horizontally.

8. A splash lubricating system recited in claim 2 wherein said cylinder is extruded at an angle to the horizontal.

* * * * *